US009620302B2

(12) United States Patent
Schmidt et al.

(10) Patent No.: US 9,620,302 B2
(45) Date of Patent: Apr. 11, 2017

(54) STORAGE MODULE FOR A HYDRAULIC STORED-ENERGY SPRING MECHANISM

(71) Applicant: ABB Technology AG, Zürich (CH)

(72) Inventors: Matthias Schmidt, Frankfurt (DE); Thomas Brenneis, Mainaschaff (DE); Jörg Knospe, Bruchköbel (DE)

(73) Assignee: ABB Schweiz AG, Baden (CH)

( * ) Notice: Subject to any disclaimer, the term of this patent is extended or adjusted under 35 U.S.C. 154(b) by 209 days.

(21) Appl. No.: 13/918,577

(22) Filed: Jun. 14, 2013

(65) Prior Publication Data

US 2013/0277190 A1 Oct. 24, 2013

Related U.S. Application Data

(63) Continuation of application No. PCT/EP2011/005644, filed on Nov. 10, 2011.

(30) Foreign Application Priority Data

Dec. 15, 2010 (DE) ..... 10 2010 054 665

(51) Int. Cl.
*H01H 3/24* (2006.01)
*H01H 33/34* (2006.01)
(Continued)

(52) U.S. Cl.
CPC ..... *H01H 3/24* (2013.01); *H01H 33/34* (2013.01); *H01H 3/301* (2013.01); *H01H 35/38* (2013.01); *H01H 2009/0083* (2013.01)

(58) Field of Classification Search
CPC ..... H01H 33/34; H01H 2009/0083; H01H 2033/308; H01H 33/40; H01H 35/38; H01H 3/301
(Continued)

(56) References Cited

U.S. PATENT DOCUMENTS 3,138,676 A 6/1964 Gratzmuller
3,175,061 A * 3/1965 Roberts et al. ..... 200/82 R
(Continued)

FOREIGN PATENT DOCUMENTS

DE 3 408 909 A1 9/1985
DE 10 2007 06229 A1 4/2009
(Continued)

OTHER PUBLICATIONS

International Search Report (PCT/ISA/210) issued on Feb. 15, 2012, by the European Patent Office as the International Searching Authority for International Application No. PCT/EP2011/005644.
(Continued)

*Primary Examiner* — Renee Luebke
*Assistant Examiner* — Ahmed Saeed
(74) *Attorney, Agent, or Firm* — Barnes & Thornburg LLP

(57) ABSTRACT

A storage module for a hydraulic stored-energy spring mechanism for operating a high-voltage switch, for example a high-voltage circuit breaker, having a spring element which acts to store energy and having a fluid for transmitting the energy of the spring element, by a moving storage piston, to a piston rod for operating the high-voltage switch, wherein the storage piston projects into the housing which is filled with fluid and the housing forms a pressurized storage reservoir for the fluid. The pressurized storage reservoir is connected to a hydraulic system of the stored-energy spring mechanism by at least one channel element which projects into the pressurized storage reservoir and a pressurized channel which is connected to the channel element. The storage piston closes a subregion of the channel element starting from a specific piston stroke "s".

36 Claims, 4 Drawing Sheets

(51) Int. Cl.

| | |
|---|---|
| *H01H 9/00* | (2006.01) |
| *H01H 35/38* | (2006.01) |
| *H01H 3/30* | (2006.01) |

(58) Field of Classification Search
USPC .... 200/81 R, 82 R; 123/90.12, 90.46, 90.55, 123/90.63
See application file for complete search history.

(56) References Cited

U.S. PATENT DOCUMENTS

| | | | | |
|---|---|---|---|---|
| 4,716,812 | A * | 1/1988 | Koerner et al. | 91/417 R |
| 5,584,180 | A * | 12/1996 | Plettner et al. | 60/413 |
| 5,624,105 | A | 4/1997 | Runkel | |
| 2011/0073420 | A1* | 3/2011 | Nagel | 188/152 |
| 2011/0132187 | A1* | 6/2011 | Lohrberg | 92/84 |

FOREIGN PATENT DOCUMENTS

| | | | |
|---|---|---|---|
| EP | 0 158 054 | A1 | 10/1985 |
| EP | 0 829 892 | A1 | 3/1998 |
| EP | 0829893 | A1 | 3/1998 |
| JP | 61157835 | A | 7/1986 |
| JP | 10079218 | A | 3/1998 |
| SU | 235133 | A1 | 1/1969 |
| WO | 2009/049768 | A1 | 4/2009 |
| WO | 2010/003589 | A1 | 1/2010 |

OTHER PUBLICATIONS

Notice of Reasons for Rejection issued Jun. 15, 2015 by the Japanese Patent Office in corresponding Japanese Patent Application No. 2013-543548, and an English translation thereof.

* cited by examiner

Ideal Spring Characteristic Curve

STORAGE MODULE FOR A HYDRAULIC STORED-ENERGY SPRING MECHANISM

RELATED APPLICATION(S)

This application claims priority as a continuation application under 35 U.S.C. §120 to PCT/EP2011/005644, which was filed as an International Application on Nov. 10, 2011 designating the U.S., and which claims priority to German Application 10 2010 054 665.8 filed in Germany on Dec. 15, 2010. The entire contents of these applications are hereby incorporated by reference in their entireties.

FIELD

The disclosure relates to a hydraulic storage module for a hydraulic stored-energy spring mechanism for actuating a high-voltage switch, for example, a high-voltage circuit breaker.

BACKGROUND INFORMATION

Stored-energy spring mechanisms for actuating high-voltage circuit breakers are known for example from DE 3408909 A1. The stored-energy spring mechanism described therein and formed as a hydraulic drive is housed together with a hydraulic store with a mechanical pressure-maintaining device in a common pressure housing, in which the conveying element for the hydraulic fluid, a high-pressure pump and also a control unit are integrated together with the appropriate hydraulic connections. The hydraulic store is intended to provide pressure energy to the hydraulic drive of the high-voltage circuit breaker without a further feed of outside energy and to actuate the drive in the intended manner, even in the event of a disruption or interruption of the energy feed.

In EP 0829892 A1, a stored-energy spring mechanism is described, with which a pre-loaded spring pressurizes a fluid via a pressure body and at least two pressure pistons. A drive rod of the stored-energy spring mechanism is moved by this fluid and is fastened on a drive piston that is slidingly displaceable in a working cylinder.

When assembling the stored-energy spring mechanism and during maintenance works, the hydraulic system of the stored-energy spring mechanism is pressureless. The pre-loaded spring is biased in this state and can be extended axially to the maximum. In so doing, the pre-loaded spring presses the pressure body against a stop on the cylinder housing, whereby the pressure body is fixed between the stop and the pre-loaded spring.

During operation of the stored-energy spring mechanism, the hydraulic system is under pressure. The pre-loaded spring is tensioned further in this state and its axial extension is reduced. In so doing, the pre-loaded spring presses the pressure body against the pressure piston, which thus pressurizes the fluid. The pressure body is fixed between the pressure piston and the pre-loaded spring.

Circuit breaker drives, which use disk springs in combination with a hydraulic piston as an energy store, are likewise known from DE 3408909 A1. The disk springs used for energy storage are compressed by a hydraulic piston, and a pressure/stroke characteristic curve of the piston, which is shown in FIG. 1*b* herein, can be derived from a force/stroke characteristic curve of the spring. Due to the degressive course of the force/stroke characteristic curve of the disk spring, the pressure change is therefore only weakly pronounced over a large part of the stroke of the piston.

As an alternative to the use of the relatively costly disk springs, there is generally the possibility of using other spring types, such as coil springs, which are of simple structure and therefore more cost effective. Due to the wide distribution and simple manufacture, coil springs are more easily obtainable on the market compared to disk springs.

In a favorable case, these coil springs can have a linear force/stroke characteristic curve as is illustrated in FIG. 1*c* herein, wherein this characteristic curve can even transition into a progressive characteristic curve in the unfavorable case. This characteristic curve could also be translated accordingly again into a pressure/stroke characteristic curve of the piston and have a strong pressure change over the stroke. This behavior can be less desirable for hydraulic drives of high-voltage circuit breakers, caused by the strong pressure change over the stroke, and compared to the degressive characteristic curve occurring with disk springs can lead to a strong pressure change over the storage stroke of the pressure piston of the energy store.

SUMMARY

A storage module for a hydraulic stored-energy spring mechanism for actuating a high-voltage switch is disclosed, comprising: a pressure-tight housing; a spring element acting as an energy store; a moveable storage piston projecting into the pressure-tight housing; and a fluid for transferring energy of the spring element by the movable storage piston to a piston rod for actuating a high-voltage switch, wherein the pressure-tight housing is filled with the fluid and the housing forms a pressurized storage reservoir for the fluid, wherein the pressurized storage reservoir is connected to a hydraulic system of the stored-energy spring mechanism via at least one sub-channel projecting into the pressurized storage reservoir and via a pressurized channel connected thereto, and wherein the storage piston closes a sub-region of the sub-channel, from a specific piston stroke (s).

A high-voltage circuit breaker drive is disclosed, comprising: a pressure-tight housing; a spring element acting as an energy store; a moveable storage piston projecting into the pressure-tight housing; and a fluid for transferring energy of the spring element by the movable storage piston to a piston rod for actuating a high-voltage switch, wherein the pressure-tight housing is filled with the fluid and the housing forms a pressurized storage reservoir for the fluid, wherein the pressurized storage reservoir is connected to a hydraulic system of the stored-energy spring mechanism via at least one sub-channel projecting into the pressurized storage reservoir and via a pressurized channel connected thereto, and wherein the storage piston closes a sub-region of the sub-channel, from a specific piston stroke (s).

BRIEF DESCRIPTION OF THE DRAWINGS

Exemplary embodiments and improvements of the disclosure and also further advantages will be explained and described in greater detail on the basis of the following Figures, in which.

DETAILED DESCRIPTION

Figure 1:
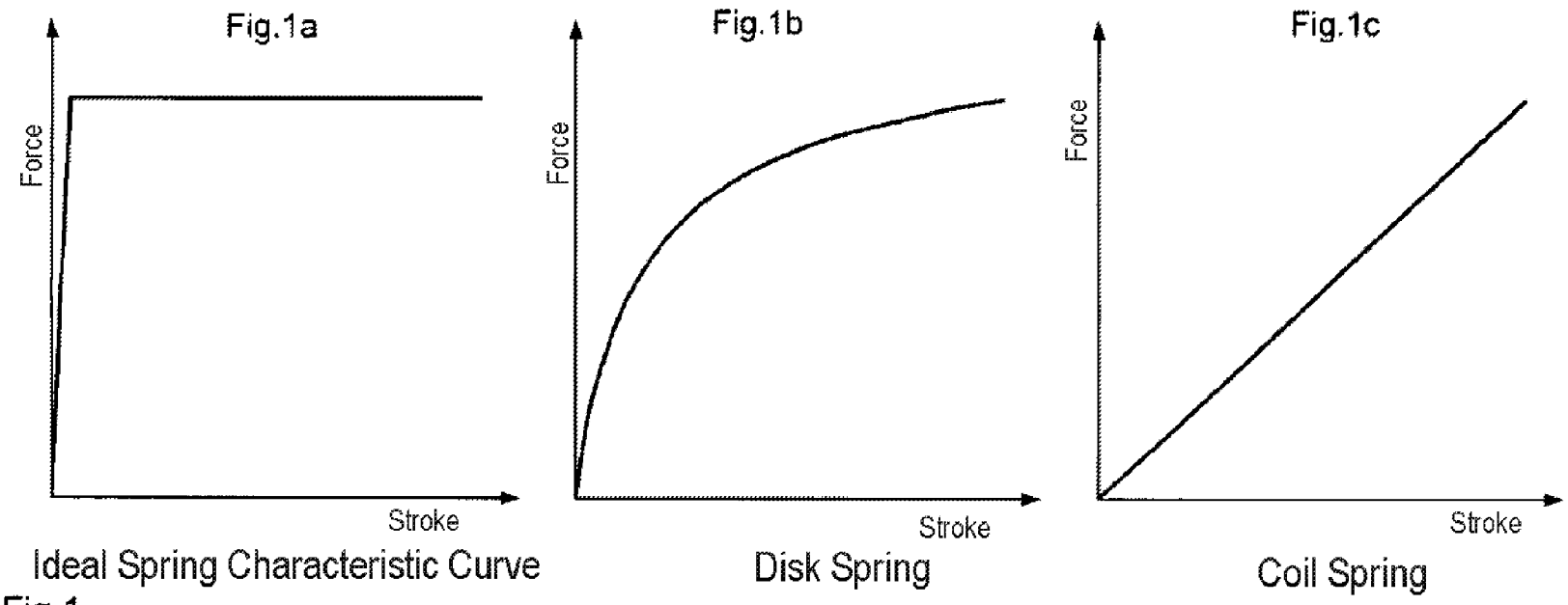
FIGS. 1*a*-1*c* show a comparison of exemplary force/stroke characteristic curves of different springs with an exemplary ideal force/stroke characteristic curve.

Exemplary embodiments of the disclosure specify a storage module for a hydraulic stored-energy spring mechanism for actuating a high-voltage switch. The module has a simple structure and the dynamic pressure/stroke characteristic curves of the module can be better adapted to the specifications of a heavy-duty circuit breaker drive.

In order to improve the pressure change over the storage stroke of the storage module of the stored-energy spring mechanism of the high-voltage switch, a dynamic characteristic curve, which is produced due to hydraulic losses in the hydraulic system of the stored-energy spring mechanism during the removal of a volume flow, can be adapted in a manner dependent on the storage stroke by the storage module according to an exemplary embodiment of the disclosure.

The storage module according to an exemplary embodiment of the disclosure for a hydraulic stored-energy spring mechanism for actuating a high-voltage switch, for example, a high-voltage circuit breaker, includes a spring element acting as an energy store and a fluid for transferring the energy of the spring element by a movable storage piston to a piston rod for actuating the high-voltage switch, wherein the storage piston projects into a pressure-tight housing filled with fluid and the housing forms a pressurized (i.e., high-pressure) storage reservoir for the fluid.

The storage piston can be guided in a closure cover in a first embodiment of a storage module according to the disclosure. In a second exemplary embodiment of a storage module according to the disclosure, the storage piston can be guided in the pressure-tight housing.

The high-pressure storage reservoir can be connected to a hydraulic system of the stored-energy spring mechanism via at least one sub-channel projecting into the high-pressure storage reservoir and via a high-pressure channel connected thereto. The storage piston closes a sub-region of the sub-channel from a specific piston stroke.

In an exemplary embodiment, the spring element acting as an energy store can be formed as a coil spring, which cooperates with a storage cylinder, which can be arranged in a pressure housing, can be formed as a plunger cylinder, and in which a storage piston movable by fluid pressure is guided. The plunger cylinder can be formed as a hollow cylinder, in the opening of which the storage piston is movably arranged.

Here, the storage piston can function simultaneously as a control slide and, from a certain piston stroke, closes, with its pressure body attached at the start of the piston, a region of a high-pressure storage reservoir of the cylinder housing, it being possible for fluid to flow through the region, wherein the piston stroke can be produced as a result of the fact that the storage module has stored more fluid in the high-pressure reservoir than is specified for implementation of C—O switching of the high-voltage switch. This throttle leads to a dynamic pressure change during the switching process on the outflowing side of the throttle point in accordance with the piston stroke.

The spring element of the storage module can thus be tensioned when the pressure body located on the storage piston is acted on by hydraulic fluid, whereby the storage piston moves in the direction of the spring element.

The return movement of the storage piston can be achieved by the relaxation of the spring element in the event of a fall in pressure. Here, the high-pressure storage volume located above the storage piston reduces as the spring element relaxes.

In an exemplary embodiment of a storage module according to the disclosure, a piston head can be fitted on the storage piston, wherein the piston head projects into the high-pressure storage reservoir located in the pressure-tight housing.

In accordance with an exemplary embodiment the disclosure, the storage piston or the piston head can include openings, which form a connection between the high-pressure storage reservoir and at least one sub-channel, through which fluid can flow.

Due to the embodiment of the storage module as a plunger cylinder, no additional components, such as seals on the piston head, are required compared to existing storage modules for high-voltage switch drives in order to implement the throttle, which is dependent on the storage stroke.

In FIG. 1, exemplary force/stroke characteristic curves of a disk spring (FIG. 1*b*) and of a coil spring (FIG. 1*c*), which can be used in a storage module for mechanical energy storage for a hydraulic stored-energy spring mechanism, are shown in comparison to an ideal force/stroke spring characteristic curve (FIG. 1*a*).

Figure 2:
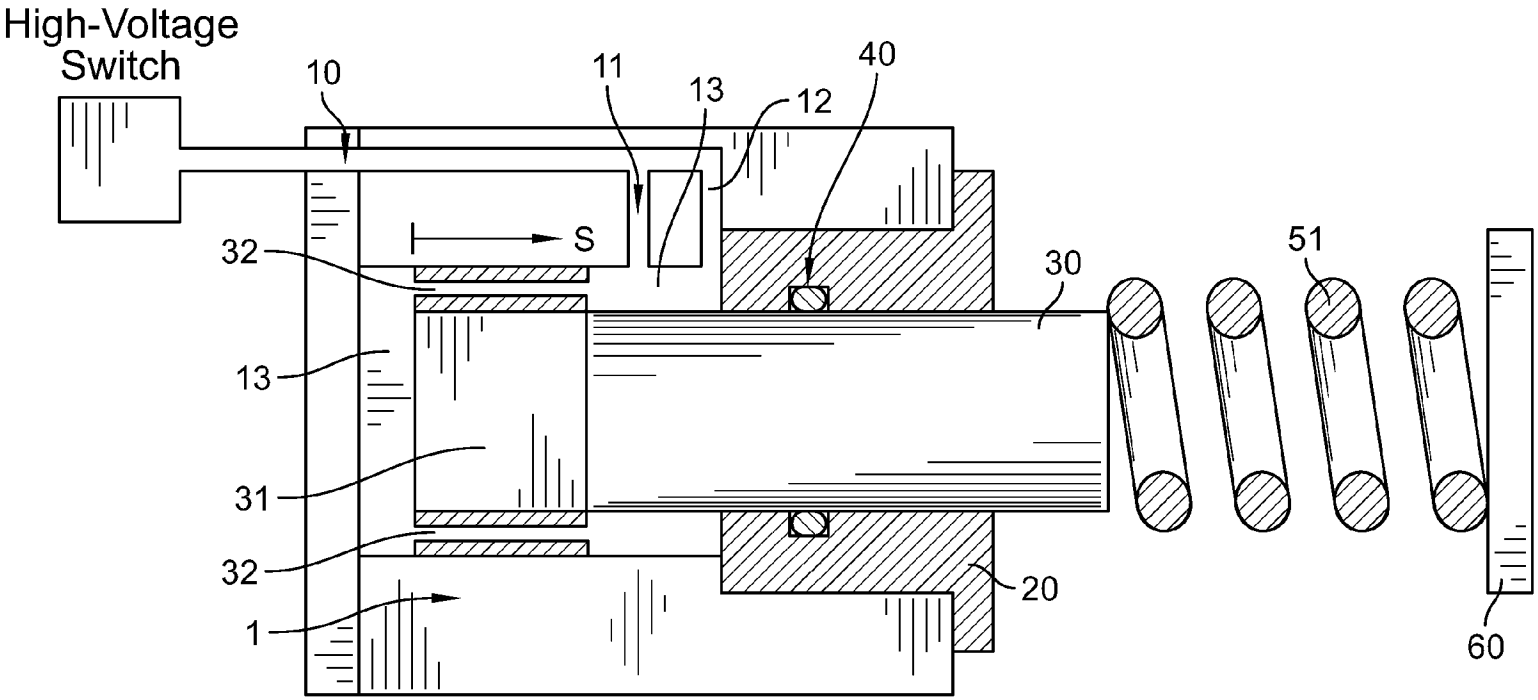
FIG. 2 shows an exemplary embodiment of a storage module according to the disclosure for a hydraulic stored-energy spring mechanism for actuating a high-voltage circuit breaker.

FIG. 2 shows, by way of example, an exemplary embodiment of a storage module according to the disclosure for a hydraulic stored-energy spring mechanism for actuating a high-voltage circuit breaker, which is arranged in a container body.

The storage module includes a spring element 51, which acts as an energy store, is formed as a coil spring, and is connected to a storage piston 30, which is arranged in a pressure housing 1, is movable by fluid pressure and is guided axially in a closure cover 20. The end of the storage piston 30 acted on by pressure is formed as a cylindrical piston head 31.

The coil spring 51 is supported at one end on a support element 60 of the container body and at the other end on the part of the storage piston 30 projecting from the pressure housing 1.

The piston head 31, which is fitted on the storage piston 30, includes openings or bores 32, which connect the oil volume in the working chamber 13, also referred to as the high-pressure storage reservoir, of the pressure housing 1 to oil volumes on the right-hand side of the piston head 31 shown in FIG. 2 and form a connection between the high-pressure storage reservoir 13 and at least one sub-channel 11, 12, through which fluid can flow.

In an exemplary embodiment of a storage module according to the disclosure, a storage piston 30 without piston head 31 can be provided, wherein the storage piston 30, on its side projecting into the high-pressure storage reservoir, includes openings 32, which form the connection between the high-pressure storage reservoir 13 and at least one sub-channel 11, 12, through which fluid can flow.

Figure 4:
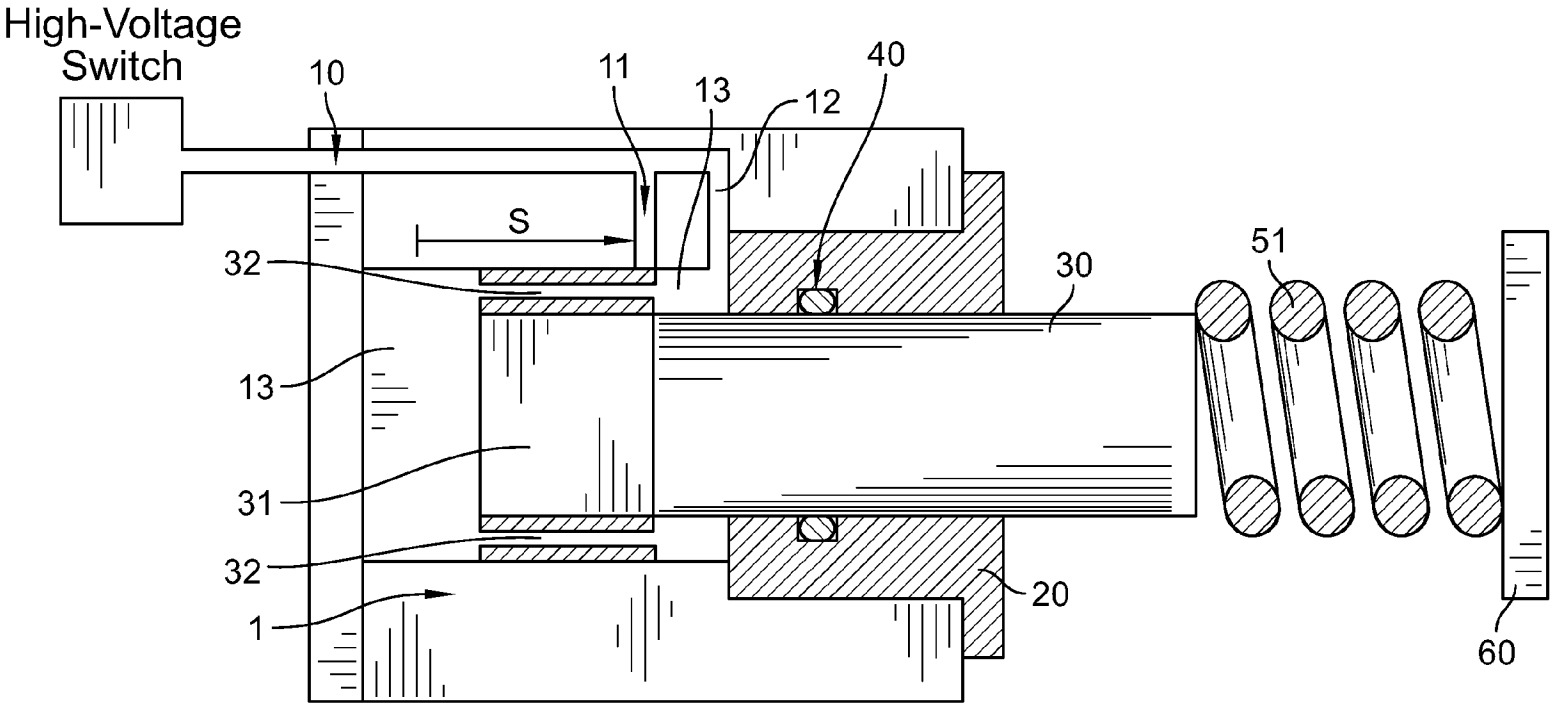
FIG. 4 shows the storage piston closing an opening between one of the sub-channels and the pressurized storage reservoir.

The storage piston 30 functions as a control slide and, from a certain piston stroke "s," closes, with its pressure body 31 attached at the start of the piston, a sub-region of the region, through which fluid can flow, of a high-pressure storage reservoir 13 located within the housing 1, the high-pressure storage reservoir also being referred to as a high-pressure volume or a working chamber of the pressure housing. See FIG. 4. This throttle occurs as soon as the storage module has stored more fluid in the high-pressure storage reservoir 13 than is specified for implementation of C—O switching of the high-pressure circuit breaker. The dynamic pressure in the high-pressure channel 10 can thus be advantageously throttled in accordance with the piston stroke "s."

A sub-channel referred to as a first region 11 and a further sub-channel referred to as a second region 12 adjoins the high-pressure channel 10. Whilst the storage module is acted on by low pressure, that is to say the amount of energy stored in the storage module is sufficient for C—O switching, fluid flows through a first region 11 and a second region 12. There is thus no dynamic pressure reduction in the high-pressure channel 10 during a switching process. If the storage module is acted on by high pressure, that is to say if the stored amount of energy is greater than specified for C—O switching, the first region 11 is closed by means of the pressure body 31 and fluid can still flow only through the second region 12. There is thus a dynamic pressure reduction in the high-pressure channel 10 during a switching process.

In an exemplary embodiment of the storage module according to the disclosure, the flow rate through at least one of the sub-channels 11, 12 can be set by means of a throttle element.

The high-pressure seal 40 illustrated in FIG. 2 is intended for fluid sealing of the storage piston 30.

Figure 3:
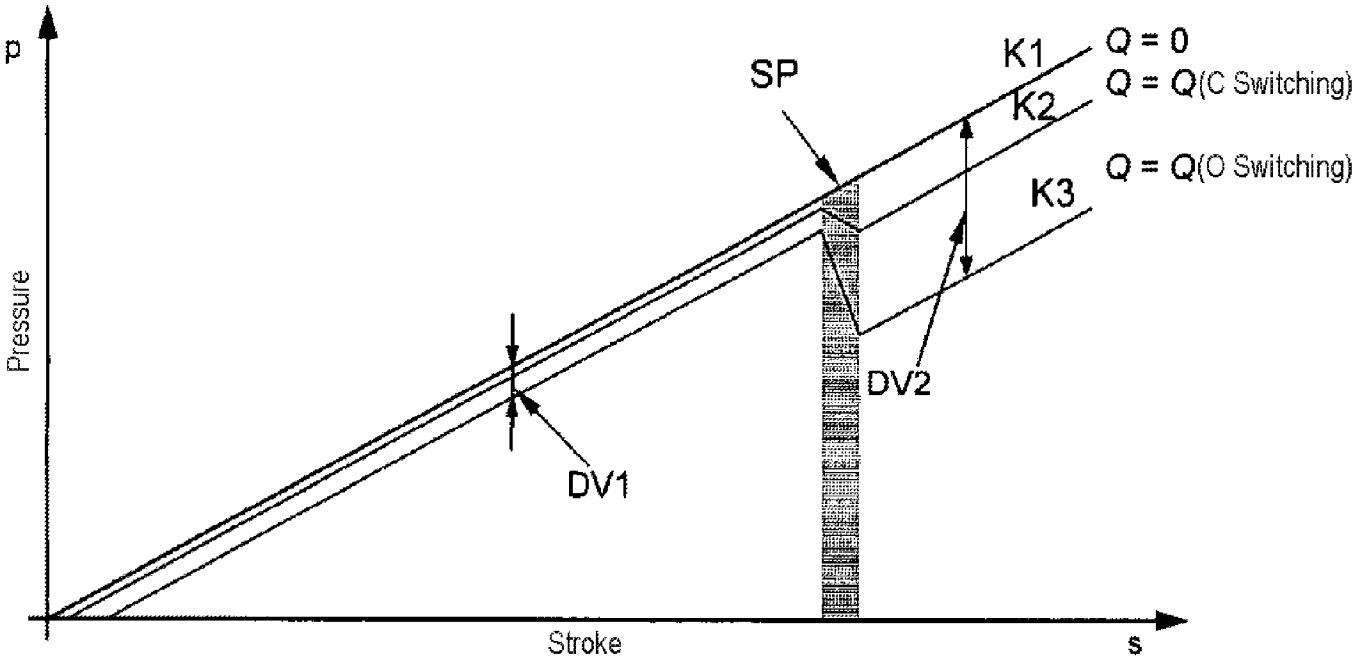
FIG. 3 shows the course of dynamic pressure/stroke characteristic curves of the storage module according to an exemplary embodiment of the disclosure.

FIG. 3 shows, by way of example, the course of an exemplary stroke/pressure characteristic curve K1 with a volume flow of 0 and, by contrast, an exemplary qualitative course of a stroke/pressure characteristic curve K2 for the C switching and a dynamic stroke/pressure characteristic curve K3 for the O switching of the high-voltage circuit breaker with a volume flow greater than 0 when the volume flow during O switching is greater than the volume flow during C switching, wherein in each case the stroke "s" of the storage piston 30 is displayed over the pressure in the system.

Because the static force/stroke characteristic curve illustrated in FIG. 1*c* of the coil spring used in the storage module can be influenced with difficulty and can therefore be adapted to the specifications of the high-pressure circuit breaker drive, exemplary embodiments of the disclosure can adapt a dynamic pressure/stroke characteristic curve, which is produced due to hydraulic losses in the storage module. The hydraulic losses are dependent on the volume flow of the high-pressure fluid in the working chamber of the pressure housing and are not influenced, or are influenced to a minimal extent, by the pressure inside the high-pressure storage volume.

If energy is then removed from the storage module at a specific rate, a defined volume flow Q thus flows and a pressure loss DV1, DV2 is thus produced directly in the working chamber of the storage module (see curve K3). A lower pressure is therefore provided at the actuation device of the circuit breaker than in the static case, in which no volume flow Q flows (see curve K1). The pressure loss is higher the greater the volume flow, and is dependent thereon exclusively (see curve K3).

With a storage module according to exemplary embodiment of the disclosure, the pressure change over the specific storage stroke "s" of the storage module of the stored-energy spring mechanism of the high-voltage switch can be advantageously improved and the dynamic pressure/stroke characteristic curve, which is produced due to hydraulic losses in the hydraulic system of the stored-energy spring mechanism, can be adapted in accordance with the stroke "s" of the storage piston 30.

If the static pressure in the storage module thus rises, the system losses thus increase, and therefore the available energy of the storage module can be reduced in the dynamic case, that is to say a volume flow Q unequal to 0. For use on hydraulic drives for high-voltage circuit breakers, it is additionally recommended to integrate precisely one switching point SP, at which the loss is changed. This switching point SP causes a stepped course of the dynamic characteristic curves K2 and K3. The volume flow Q generally differs between O switching and C switching. This is shown by way of example in FIG. 3 as a qualitative course of the characteristic curve K2 for C switching and as a dynamic characteristic curve K3 for O switching, wherein in each case the stroke "s" of the storage piston 30 is illustrated over the pressure in the system.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SIGNS

1 pressure-tight housing, pressure housing
10 high-pressure channel (filled with pressurized fluid)
11 first region, sub-channel
12 second region, further sub-channel
13 high-pressure storage reservoir, high-pressure volume, working chamber in the pressure housing
20 closure cover
30 storage piston
31 pressure body, piston head
32 openings, bores in the piston head
40 high-pressure seal
51 spring element, coil spring
60 support element
s stroke of the storage piston
DV1 pressure loss in the hydraulic system of the stored-energy spring mechanism due to low losses in the hydraulic system
DV2 pressure loss in the hydraulic system of the stored-energy spring mechanism due to high losses in the hydraulic system
SP switching point
Q volume flow
K1 stroke/pressure characteristic curve
K2 stroke/pressure characteristic curve for C switching
K3 stroke/pressure characteristic curve for O switching

What is claimed is:

1. A storage module for a hydraulic drive for actuating a high-voltage switch, the storage module comprising:

a pressure-tight housing including (i) a first sub-channel hydraulically connectable to the hydraulic drive and (ii) a second sub-channel hydraulically connectable to the hydraulic drive;

a spring element acting as an energy store;

a moveable storage piston projecting into the pressure-tight housing; and a fluid for transferring energy from the spring element via the movable storage piston to the hydraulic drive for actuating the high-voltage switch;

wherein the pressure-tight housing is filled with the fluid and the housing forms a storage reservoir for the fluid;

wherein the storage reservoir is pressurized by the fluid when the spring element actuates the movable storage piston at high-pressure;

wherein the storage reservoir is hydraulically connected to the second sub-channel; and wherein the movable storage piston (i) blocks a hydraulic connection between the storage reservoir and the first sub-channel during a first range of a stroke of the movable storage piston and (ii) opens the hydraulic connection between the storage reservoir and the first sub-channel during a second range of the stroke of the movable storage piston.

2. The storage module as claimed in claim 1, wherein the spring element is a coil spring.

3. The storage module as claimed in claim 1, wherein the movable storage piston is guided in a closure cover or in the pressure-tight housing.

4. The storage module as claimed in claim 1, wherein the movable storage piston comprises:

a piston head projecting into the storage reservoir located in the pressure-tight housing; and a piston rod connected to the piston head on a side of the piston head facing the spring element;

wherein the piston head (i) blocks the hydraulic connection between the storage reservoir and the first sub-channel during the first range of the stroke of the movable storage piston and (ii) opens the hydraulic connection between the storage reservoir and the first sub-channel during the second range of the stroke of the movable storage piston.

5. The storage module as claimed in claim 1, further comprising:

a throttle element for setting the flow rate through at least one of the first and second sub-channels.

6. The storage module as claimed in claim 1, wherein the stroke of the movable storage piston is produced as a result of the storage module having stored more fluid in the storage reservoir than is necessary for implementation of C—O switching of the high-voltage switch.

7. The storage module as claimed in claim 1, wherein the storage module is formed as a plunger cylinder.

8. The storage module as claimed in claim 1, wherein the pressure-tight housing further includes a common channel hydraulically connected to the first and second sub-channels, and wherein hydraulic losses in the common channel differ when the movable storage piston is in the first range of the stroke as compared to when the movable storage piston is in the second range of the stroke such that a dynamic pressure/stroke characteristic curve is achieved for the storage module.

9. The storage module as claimed in claim 1, wherein the movable storage piston includes one or more openings that form a hydraulic connection between the storage reservoir and at least one of the first and second sub-channels.

10. The storage module as claimed in claim 4, wherein piston head of the movable storage piston includes one or more openings that form a hydraulic connection between the storage reservoir and at least one of the first and second sub-channels.

11. The storage module as claimed in claim 1, wherein the first sub-channel discharges laterally into the storage reservoir relative to a stroke direction defined by the stroke of the movable piston head.

12. The storage module as claimed in claim 1, wherein a pressure loss in the storage reservoir is higher when the movable storage piston is in the second range of the stroke as compared to when the movable storage piston is in the first range of the stroke.

13. A high-voltage circuit breaker drive, comprising:

a working cylinder for actuating a high-voltage switch;

a pressure-tight housing including (i) a first sub-channel hydraulically connected to the working cylinder and a (ii) second sub-channel hydraulically connected to the working cylinder;

a spring element acting as an energy store;

a moveable storage piston projecting into the pressure-tight housing; and a fluid for transferring energy from the spring element via the movable storage piston to the working cylinder for actuating the high-voltage switch;

wherein the pressure-tight housing is filled with the fluid and the housing forms a pressurized storage reservoir for the fluid;

wherein the storage reservoir is pressurized by the fluid when the spring element actuates the movable storage piston at high-pressure;

wherein the storage reservoir is hydraulically connected to the second sub-channel; and wherein the movable storage piston (i) blocks a hydraulic connection between the storage reservoir and the first sub-channel during a first range of a stroke of the movable storage piston and (ii) opens the hydraulic connection between the storage reservoir and the first sub-channel during a second range of the stroke of the movable storage piston.

14. The high-voltage circuit breaker drive as claimed in claim 13, wherein the spring element is a coil spring.

15. The high-voltage circuit breaker drive as claimed in claim 13, wherein the movable storage piston is guided in a closure cover or in the pressure-tight housing.

16. The high-voltage circuit breaker drive as claimed in claim 13, wherein the movable storage piston comprises:

a piston head projecting into the storage reservoir located in the pressure-tight housing; and a piston rod connected to the piston head on a side of the piston head facing the spring element;

wherein the piston head (i) blocks the hydraulic connection between the storage reservoir and the first sub-channel during the first range of the stroke of the movable storage piston and (ii) opens the hydraulic connection between the storage reservoir and the first sub-channel during the second range of the stroke of the movable storage piston.

17. The high-voltage circuit breaker drive as claimed in claim 13, further comprising:

a throttle element for setting the flow rate through at least one of the first and second sub-channels.

18. The high-voltage circuit breaker drive as claimed in claim 13, wherein the stroke of the movable storage piston is produced as a result of the storage module having stored more fluid in the storage reservoir than is necessary for implementation of C—O switching of the high-voltage switch.

19. The high-voltage circuit breaker drive as claimed in claim 13, wherein the pressure-tight housing is formed as a plunger cylinder.

20. The high-voltage circuit breaker drive as claimed in claim 13, further comprising a common channel hydraulically connecting to the first and second sub-channels to the working cylinder, wherein hydraulic losses in the common channel differ when the movable storage piston is in the first range of the stroke as compared to when the movable storage piston is in the second range of the stroke such that a dynamic pressure/stroke characteristic curve is achieved.

21. The high-voltage circuit breaker drive as claimed in claim 13, wherein the movable storage piston includes one or more openings that form a hydraulic connection between the storage reservoir and at least one of the first and second sub-channels.

22. The high-voltage circuit breaker drive as claimed in claim 16, wherein piston head of the movable storage piston includes one or more openings that form a hydraulic connection between the storage reservoir and at least one of the first and second sub-channels.

23. The high-voltage circuit breaker drive as claimed in claim 13, wherein the first sub-channel discharges laterally into the storage reservoir relative to a stroke direction defined by the stroke of the movable piston head.

24. The high-voltage circuit breaker drive as claimed in claim 13, wherein a pressure loss in the storage reservoir is higher when the movable storage piston is in the second range of the stroke as compared to when the movable storage piston is in the first range of the stroke.

25. A switch gear comprising:

a high-voltage switch; and a high-voltage circuit breaker drive comprising:

a working cylinder for actuating the high-voltage switch;

a pressure-tight housing including (i) a first sub-channel hydraulically connected to the working cylinder and a (ii) second sub-channel hydraulically connected to the working cylinder;

a spring element acting as an energy store;

a moveable storage piston projecting into the pressure-tight housing; and a fluid for transferring energy from the spring element via the movable storage piston to the working cylinder for actuating the high-voltage switch;

wherein the pressure-tight housing is filled with the fluid and the housing forms a pressurized storage reservoir for the fluid;

wherein the storage reservoir is pressurized by the fluid when the spring element actuates the movable storage piston at high-pressure;

wherein the storage reservoir is hydraulically connected to the second sub-channel; and wherein the movable storage piston (i) blocks a hydraulic connection between the storage reservoir and the first sub-channel during a first range of a stroke of the movable storage piston and (ii) opens the hydraulic connection between the storage reservoir and the first sub-channel during a second range of the stroke of the movable storage piston.

26. The switch gear as claimed in claim 25, wherein the spring element is a coil spring.

27. The switch gear as claimed in claim 25, wherein the movable storage piston is guided in a closure cover or in the pressure-tight housing.

28. The switch gear as claimed in claim 25, wherein the movable storage piston comprises:

a piston head projecting into the storage reservoir located in the pressure-tight housing; and a piston rod connected to the piston head on a side of the piston head facing the spring element;

wherein the piston head (i) blocks the hydraulic connection between the storage reservoir and the first sub-channel during the first range of the stroke of the movable storage piston and (ii) opens the hydraulic connection between the storage reservoir and the first sub-channel during the second range of the stroke of the movable storage piston.

29. The switch gear as claimed in claim 28, wherein piston head of the movable storage piston includes one or more openings that form a hydraulic connection between the storage reservoir and at least one of the first and second sub-channels.

30. The switch gear as claimed in claim 25, wherein the high-voltage circuit breaker drive further comprises:

a throttle element for setting the flow rate through at least one of the first and second sub-channels.

31. The switch gear as claimed in claim 25, wherein the stroke of the movable storage piston is produced as a result of the storage module having stored more fluid in the storage reservoir than is necessary for implementation of C—O switching of the high-voltage switch.

32. The switch gear as claimed in claim 25, wherein the pressure-tight housing is formed as a plunger cylinder.

33. The switch gear as claimed in claim 25, wherein the high-voltage circuit breaker drive further comprises a common channel hydraulically connecting to the first and second sub-channels to the working cylinder, wherein hydraulic losses in the common channel differ when the movable storage piston is in the first range of the stroke as compared to when the movable storage piston is in the second range of the stroke such that a dynamic pressure/stroke characteristic curve is achieved.

34. The switch gear as claimed in claim 25, wherein the movable storage piston includes one or more openings that form a hydraulic connection between the storage reservoir and at least one of the first and second sub-channels.

35. The switch gear as claimed in claim 25, wherein the first sub-channel discharges laterally into the storage reservoir relative to a stroke direction defined by the stroke of the movable piston head.

36. The switch gear as claimed in claim 25, wherein a pressure loss in the storage reservoir is higher when the movable storage piston is in the second range of the stroke as compared to when the movable storage piston is in the first range of the stroke.

* * * * *